US006955417B2

(12) United States Patent
Yokouchi et al.

(10) Patent No.: US 6,955,417 B2
(45) Date of Patent: Oct. 18, 2005

(54) INKJET RECORDING HEAD AND INKJET PRINTER

(75) Inventors: Tsutomu Yokouchi, Kanagawa (JP); Kazuo Sanada, Kanagawa (JP); Kazuhiro Tsujita, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 44 days.

(21) Appl. No.: 10/400,910

(22) Filed: Mar. 28, 2003

(65) Prior Publication Data

US 2003/0218655 A1 Nov. 27, 2003

(30) Foreign Application Priority Data

Mar. 28, 2002 (JP) ..... 2002-092875

(51) Int. Cl.[7] ..... B41J 2/14; B41J 2/16
(52) U.S. Cl. ..... 347/47; 347/40; 347/44
(58) Field of Search ..... 347/47, 40, 20, 347/44, 56, 61, 54

(56) References Cited

U.S. PATENT DOCUMENTS

| | | | | | |
|---|---|---|---|---|---|
| 3,886,565 | A | * | 5/1975 | Kojima | 347/47 |
| 4,336,544 | A | * | 6/1982 | Donald et al. | 347/54 |
| 4,368,477 | A | * | 1/1983 | Heinzl et al. | 347/40 |
| 4,404,573 | A | * | 9/1983 | Kocot et al. | 347/55 |
| 4,479,135 | A | * | 10/1984 | Kohashi | 347/55 |
| 4,665,409 | A | * | 5/1987 | Behrens et al. | 347/47 |
| 5,467,115 | A | * | 11/1995 | Childers | 347/47 |
| 5,534,903 | A | * | 7/1996 | Hayakawa et al. | 347/71 |
| 5,801,730 | A | * | 9/1998 | Shima et al. | 347/55 |
| 5,896,154 | A | | 4/1999 | Mitani et al. | |
| 5,992,974 | A | * | 11/1999 | Miyata | 347/47 |
| 6,074,045 | A | * | 6/2000 | Bergman et al. | 347/55 |
| 6,092,889 | A | * | 7/2000 | Nakamoto et al. | 347/55 |
| 6,220,696 | B1 | * | 4/2001 | Suetsugu et al. | 347/55 |
| 6,467,884 | B1 | * | 10/2002 | Murooka et al. | 347/64 |
| 6,507,001 | B1 | * | 1/2003 | Kubby | 219/121.71 |
| 6,527,369 | B1 | * | 3/2003 | Weber et al. | 347/47 |
| 6,557,974 | B1 | * | 5/2003 | Weber | 347/47 |

FOREIGN PATENT DOCUMENTS

| | | | | | |
|---|---|---|---|---|---|
| JP | 60208247 | A | * | 10/1985 | B41J 3/04 |
| JP | 07171956 | A | | 7/1995 | |
| JP | 2000351210 | A | | 12/2000 | |
| JP | 2001038917 | A | * | 2/2001 | B41J 2/135 |
| JP | 2001105584 | A | * | 4/2001 | B41J 2/01 |

* cited by examiner

*Primary Examiner*—Manish Shah
*Assistant Examiner*—Leonard Liang
(74) *Attorney, Agent, or Firm*—Whitham, Curtis & Christofferson, P.C.

(57) ABSTRACT

An inkjet recording head includes nozzles arrayed in one direction and ink droplet ejecting devices formed in the respective nozzles. Each nozzle has a height difference in a depthwise direction on a side on which ink droplets are ejected and an ink liquid surface is formed between both edges forming the height difference. An inkjet printer uses this inkjet recording head. The inkjet recording head can eject ink obliquely to the ejection surface for correcting recording pitches at joining portions and preventing the periphery of the nozzles from being contaminated by the ink splashed back from image receiving paper. The ejection angle and the ejecting direction can also be suitably selected and adjusted.

17 Claims, 6 Drawing Sheets

INKJET RECORDING HEAD AND INKJET PRINTER

BACKGROUND OF THE INVENTION

1. Field of the Invention

The present invention relates generally to a technical field of an inkjet recording system utilized for a variety of printers, and more particularly to an inkjet recording head that actualizes an ink ejection in a direction oblique to an ejection surface without any declines of productivity and workability and to an inkjet printer utilizing this inkjet recording head.

2. Description of the Related Art

A thermal inkjet recording system in which part of ink is quickly vaporized by heating with a heater and ink droplets are ejected from a nozzle by a force of expansion thereof onto a recording medium for recording has hitherto been utilized for a variety of printers (refer to JP 48-9622 A and JP 54-51837 A).

According to such a thermal inkjet recording system (which will hereinafter be simply called the inkjet system), nozzles from which ink (ink droplets) is ejected are normally bored in a plate member called an orifice plate or a nozzle plate, and the ink is ejected from the nozzles in a direction orthogonal to an ink ejection surface (a plate surface).

On the other hand, a scheme in which ink is ejected obliquely to the ejection surface (which will hereinafter be referred to as an "oblique ejection" or the like), is considered in the expectation that a variety of effects might be yielded.

What is known as a recording head in which a line head containing an array of nozzles extending in excess of one side of a sheet of image receiving paper can be manufactured at a low cost but with a high yield, is, for instance, an inkjet recording head (which will hereinafter simply be referred to as a recording head) that is elongated by arranging a plurality of small-sized recording heads (which will hereinafter simply called short heads) in a nozzle array direction.

Even in this type of recording head configured by arranging those short heads, it is required that a uniform and proper nozzle pitch be kept over an entire area of the nozzle array in order to record a high-quality image. An interval between the outermost nozzle of a short head and the edge of the short head in the nozzle array direction of the short head is, however, normally larger than the nozzle pitch Accordingly, if the short heads are arranged simply by abutting the edges on each other, it follows that the nozzle pitch increases at the joining portion between the respective short heads.

What is disclosed as a scheme for obviating this problem in JP 7-171956 A, is a recording head elongated by arraying a plurality of short heads, in which the nozzles of the respective short heads are inclined by 5° to 10° with respect to the ejection surface in the nozzle array direction, thereby ejecting the ink obliquely.

This recording head is capable of correcting an error in the nozzle pitch at the joining portion between the short heads in an ink impinging position (on the image receiving paper) by obliquely ejecting ink, i.e., capable of recording an image with a predetermined recording density over the entire area in the nozzle array direction of the recording head.

Further, streaky unevenness and spots are factors that may cause the decline of the image quality in the inkjet printer.

To obviate this problem, JP 2001-105584 A discloses an inkjet printer (inkjet recording apparatus) constructed to prevent occurrences of streaks and spots by disposing a plurality of heaters for a single nozzle and driving the respective heaters individually thereby changing at random directions in which ink is ejected from the respective nozzles during image recording.

Moreover, clogging in the nozzle of the recording head and the decline of the image quality due to contamination around the nozzle, are known as troubles in the inkjet printer. One factor that may cause these troubles is that some quantity of ink ejected from the nozzle and impinging upon the image receiving paper is splashed back from the image receiving paper, then adhered to the peripheral portion of the nozzle and dried.

What is known as a scheme for preventing this inconvenience is a method of preventing the contamination around the nozzle by obliquely ejecting ink in the direction orthogonal to the nozzle array and thus allowing the ink splashed back from the image receiving paper to flow in a direction spaced away from the nozzle.

Thus, the oblique ejection of ink in the inkjet system has many merits. While on the other hand, this oblique ejection is more disadvantageous in terms of a productivity of the recording head and so forth than in the normal recording head.

For example, boring the orifice plate obliquely (to the plate surface) to form the nozzle involves by far more laborious operations than forming the hole orthogonally to the plate surface and is disadvantageous in terms of the productivity, a production cost and a yield of the recording head.

Further, the inkjet printer disclosed in JP 2001-105584 A must have a plurality of heaters for one nozzle and is therefore still disadvantageous in terms of the productivity and the production cost of the recording head. This inkjet printer has also a low degree of freedom in the present situation where the hyperfine structure of the recording head is accelerated with a higher resolution. Moreover, the plurality of heaters are driven at random, and therefore the recording control becomes complicated.

SUMMARY OF THE INVENTION

It is an object of the present invention, which was devised to obviate the problems inherent in the prior arts, to provide an inkjet recording head elongated by joining the above-mentioned plurality of short head, capable of ejecting and flying ink (ink droplets) in a direction oblique to an ink ejection surface of an orifice plate, etc. in a way that meets a variety of purposes in various inkjet recording heads such as optimizing a recording density at a short heat joining portion, preventing contamination of the ink splashed around the nozzle, and exhibiting preferable productivity and workability.

Another object of the present invention is to provide an inkjet printer using this inkjet recording head.

In order to attain the object described above, the first aspect of the present invention provides an inkjet recording head comprising:

a plurality of nozzles arrayed in one direction; and ink droplet ejecting means formed with respect to each of the plurality of nozzles, wherein at least one of the plurality of nozzles has a height difference in a depthwise direction on a side on which ink droplets are ejected and an ink liquid surface is formed between both edges forming the height difference.

Preferably, the height difference in the depthwise direction of each of the plurality of nozzles changes stepwise from a starting edge toward an ending edge of the height difference.

Further, preferably, the height difference in the depthwise direction of each of the plurality of nozzles changes continuously from a starting edge toward an ending edge of the height difference.

Further, preferably, the height difference in the depthwise direction of each of the plurality of nozzles is provided by forming a flared portion in at least part of a periphery of each of the plurality of nozzles on a surface side on which the ink droplets are ejected.

Further, preferably, an inner wall surface of at least one of the plurality of nozzles is subjected, on a side on which the ink droplets are ejected, to ink-philic processing and ink-repellent processing in asymmetry with respect to each central axis of at least one of the plurality of nozzles.

Furthermore, in order to attain the object described above, the second aspect of the present invention provides an inkjet recording head comprising:

a plurality of nozzles arrayed in one direction; and ink droplet ejecting means formed with respect to each of the plurality of nozzles, wherein an inner wall surface of at least one of the plurality of nozzles is subjected, on a side on which the ink droplets are ejected, to ink-philic processing and ink-repellent processing in asymmetry with respect to a central axis of the at least one of the plurality of nozzles.

In the first and second aspects of the present invention, preferably, an inclination of an ink droplet-ejecting direction from a central axis direction of each of the plurality of nozzles is adjusted by at least one of a magnitude of the height difference in the depthwise direction of each of the plurality of nozzles, and a size of an area where the height difference in the depthwise direction is to be provided.

Further, preferably, the inkjet recording head further comprises power adjusting means for adjusting power of the ejecting means which is used to adjust an inclination of an ink droplet-ejecting direction from a central axis direction of each of the plurality of nozzles as determined by at least one of a magnitude of the height difference in the depthwise direction of each of the plurality of nozzles, and a size of an area where the height difference in the depthwise direction is to be provided.

Furthermore, the third aspect of the present invention provides an inkjet printer using an inkjet recording head according to the first or second aspect of the present Invention described above

DETAILED DESCRIPTION OF THE PREFERRED EMBODIMENTS

An inkjet recording head and an inkjet printer utilizing this inkjet recording head according to the present invention, will hereinafter be described in detail by way of preferred embodiments illustrated in the accompanying drawings.

Note that the inkjet recording head of the present invention may also be either a so-called line head in which nozzles are arranged so as to correspond to an entire area of one side of a sheet of image receiving paper (image receiving medium) used or an inkjet recording head adapted for a printer in which an intermittent conveyance of the image receiving paper is combined with a scan effected in a direction orthogonal to an alignment of the nozzles.

Further, the following description refers to the case where the inkjet recording head of the present invention is applied to a so-called thermal inkjet recording head in which ink droplets are ejected by the air bubble growth energy through quick heating of ink.

The present invention is not, however, limited to this type of recording head and can be preferably applied to a variety of inkjet recording heads such as electrostatic and actuator types of inkjet recording heads that eject the ink droplets by vibrating a diaphragm using static electricity, a piezoelectric device and so on, as disclosed in, e.g., JP 11-207956 A and JP 11-309850 A.

Moreover, the illustrated case is a top shooter type inkjet (face inkjet) recording head that ejects ink in a direction substantially orthogonal to a substrate surface corresponding to a direction in which liquid is supplied to nozzles. However, the present invention may be applied to, other than this top shooter type, a side shooter type inkjet (edge inkjet) recording head that ejects ink substantially parallel with the substrate surface, as disclosed in JP 11-263014 A.

Figure 1A:
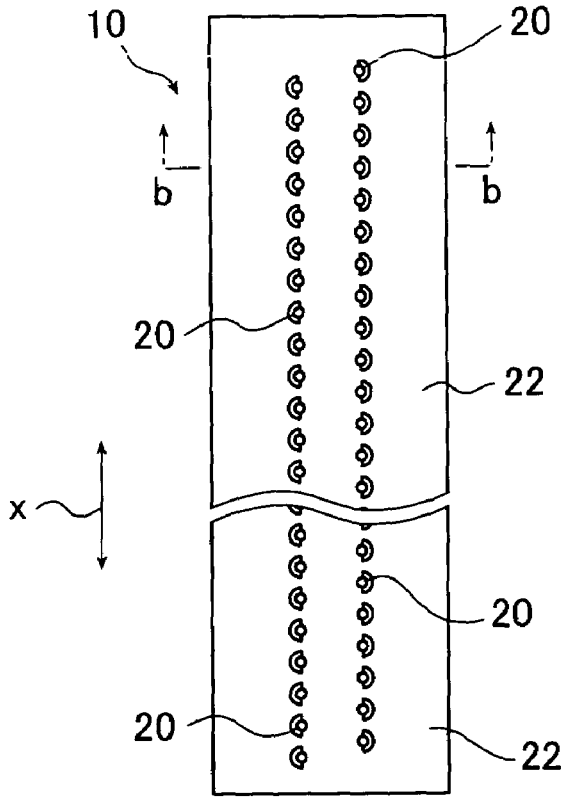
FIG. 1A is a schematic plan view showing one embodiment of an inkjet recording head of the present invention.
Figure 1B:
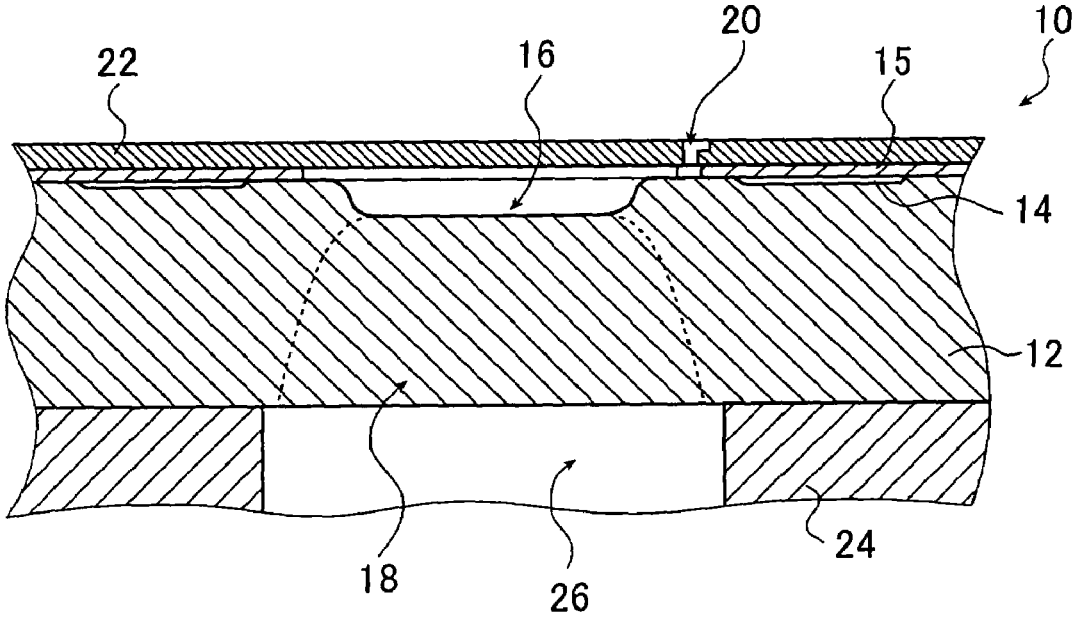
FIG. 1B is a sectional view taken along the line b—b in FIG. 1A.

FIGS. 1A and 1B are schematic views showing the construction of one embodiment of the inkjet recording head of the present invention. FIG. 1A is a plan view of the inkjet recording head as viewed from the ink ejecting direction in the illustrated case orthogonal to the substrate surface. FIG. 1B is a sectional view taken along the line b—b in FIG. 1A.

An inkjet recording head (which will hearinafter simply be referred to as a recording head) 10 shown in FIGS. 1A and 1B, includes two rows of nozzles (which will hearinafter be called nozzle rows) arrayed in one direction (which is an arrow direction x in FIG. 1A and perpendicular to the sheet surface in FIG. 1B), thereby improving the recording density. In the illustrated case, the nozzles 20 are, though explained later in further detail, formed in an orifice plate 22 laminated on a Si substrate 12 that is separated by a portion wall 15.

In the thus constructed recording head 10, as in the case of the normal type of inkjet recording head, the recording head 10 and the image receiving paper are moved relatively in the direction orthogonal to the nozzle row direction in a state where the nozzles 20 face to the image receiving paper, the ink droplets are ejected by driving heaters 30 (see FIG. 2A) corresponding to the respective nozzles 20 through modulation in accordance with the image to be recorded, thereby recording an image on the image receiving paper.

Note that the recording head 10 of the present invention is not limited to the configuration including the two rows of nozzles as in the illustrated case and may take configurations having a single row of nozzles or three or more rows of nozzles. Further, colors of the ink ejected from the respective nozzle rows and combinations thereof may be determined as desired.

The recording head 10 in the illustrated case is manufactured on the Si substrate 12 by utilizing a semiconductor device manufacturing technology. The heaters 30 (see FIG. 2A) which are formed for the respective nozzles 20 and allows ink to be ejected from the nozzles 20 by the energy of air bubbles generated through heating of ink, a drive integrated circuit 14 (which will hereinafter be called a drive circuit 14) for driving the heaters 30 and the like are formed in the Si substrate 12.

Further, in the Si substrate 12 are formed an ink groove 16 for supplying ink to the respective heaters 30 (nozzles 20) and ink supply holes 18 for supplying ink to the ink groove 16.

The ink groove 16 is dug in the nozzle row direction in the surface of the Si substrate 12 on the side on which ink is ejected. On the other hand, the Si substrate 12 is perforated with the ink supply holes 18 so as to make the back side of the substrate 12 communicate with the ink groove 16. The plurality of holes 18 are thus formed in the nozzle row direction at predetermined intervals.

The partition wall 15 is formed on the Si substrate 12 which constitutes individual ink supply paths leading from the ink groove 16 to the respective heater 30 that encompass the nozzles 20. The partition wall 15 will be described later in further detail. The orifice plate 22 in which the cylindrical nozzles 20 are formed is bonded to the partition wall 15 so as to cover the surface of the Si substrate 12.

The orifice plate 22 and the partition wall 15 may be made of any known materials such as polyimide.

The Si substrate 12 (Si chip) is bonded and fixed (mounted) in a predetermined position on a frame 24 serving as a support member, and further this frame 24 is attached in a predetermined position on an unillustrated head unit (e.g., a so-called cartridge, etc.) of the inkjet printer.

In the frame 24 and the head unit are formed ink supply paths (ink flow paths in the frame 24) for supplying ink from an ink tank attached to the head unit to the ink supply holes 18 formed in the Si substrate 12.

Figure 2A:
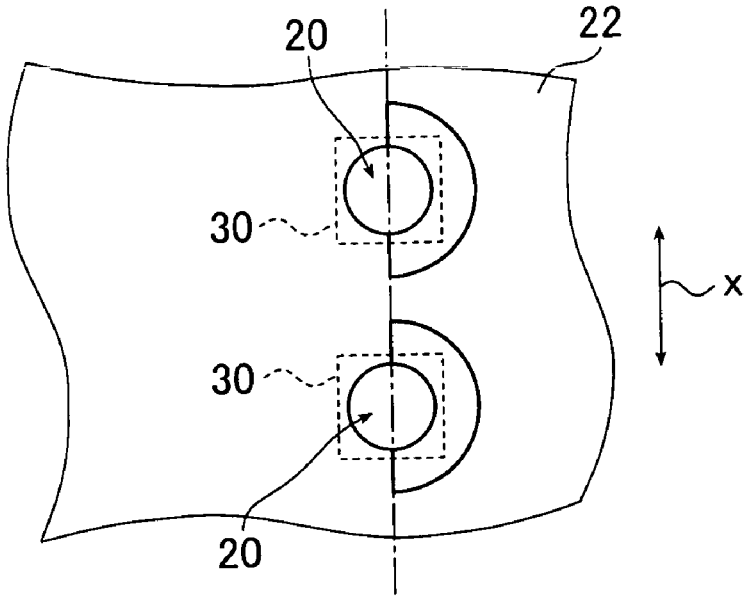
FIG. 2A is a partially enlarged schematic plan view of FIG. 1A.
Figure 2B:
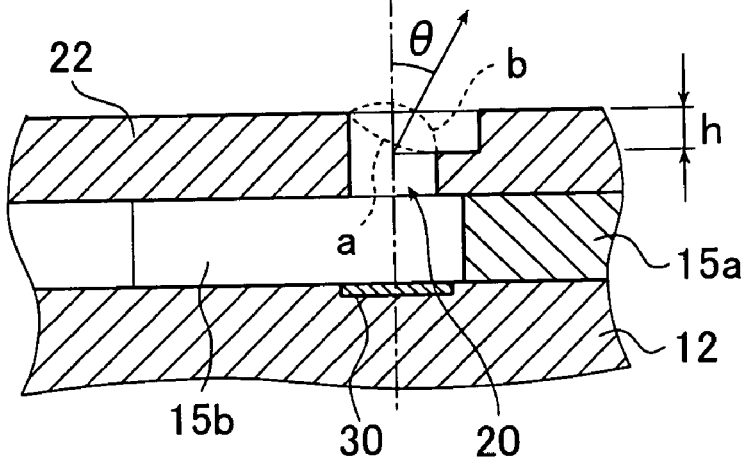
FIG. 2B is a sectional view taken in a scan direction.

FIGS. 2A and 2B show schematic views showing the vicinities of the nozzles 20 of the recording head 10. FIG. 2A is a plan view, and FIG. 2B is the same sectional view (taken in the direction orthogonal to the nozzle row) as FIG. 1B. Accordingly, in FIG. 2B, the nozzle row direction (the arrow direction x) is perpendicular to the sheet surface.

As described above, the heaters 30 in the recording head 10, serving as the ink ejection means for ejecting ink from the nozzles 20, are provided in the Si substrate 12.

The heaters 30 are usually utilized in the inkjet recording head and are each formed from, for example, conductor thin films configuring one pair of electrodes spaced apart from each other, and a heat-generating thin resistor that connects the conductor thin films.

As explained above, the partition wall 15 which constitutes the individual ink supply paths leading to the respective heaters 30 (nozzles 20) is formed on the Si substrate 12

In the illustrated case, the partition wall 15 includes an area 15*a* covering the entire surface of the substrate opposite to the ink groove 16 with respect to the nozzle rows except the neighborhood of the nozzles 20, and a wall portion 15*b* which projects from the area 15*a* toward the ink groove 16 between adjacent nozzles 20 and constitutes the individual ink supply paths to the respective heaters 30.

The illustrated case shows the so-called top shooter type recording head 10 that ejects ink upward from the surface of the Si substrate 12, which constitutes the recording head, and the partition wall 15 is covered with the orifice plate 22 having the nozzles 20 (nozzle row) formed therein.

In the thus constructed recording head 10, ink supplied via a predetermined route from the ink tank attached to the head unit is supplied through the ink supply paths 26 of the frame 24, enters the ink supply holes 18 from the back side of the Si substrate 12, and is introduced into the ink groove 16 formed on the surface of the Si substrate 12.

The ink supplied to the ink groove 16 is led to the individual ink supply paths spaced apart for the respective heaters 30 by the wall portion 15*b* of the partition wall 15, and is ejected through the corresponding nozzles 20 with nucleate boiling generated by heating the respective heaters 30 under the drive by the drive circuit 14.

Herein, the inkjet recording head according to the first aspect of the present invention includes the nozzles which have each a stepwise difference in a depthwise direction, that is, a height difference. In the recording head 10 of the illustrated case, a flared portion is formed in each nozzle 20 by digging in the half of the periphery of the nozzle 20 in a substantially fan shape, so that the nozzle 20 has a stepwise difference in the depthwise direction and thus has a height difference provided stepwise in the depthwise direction. In other words, the nozzle 20 has a stepwise difference in the depthwise direction on the surface side of the orifice plate 22 (on the side on which ink droplets are ejected).

According to the present invention, each of the nozzles is given such a height difference, whereby ink droplets can be ejected obliquely at a predetermined angle with respect to the direction orthogonal to the substrate surface or the direction parallel to the central axis of the nozzle.

In the recording head 10, when the nozzle 20 is refilled with ink, an ink liquid surface (meniscus surface) is formed obliquely so as to connect both edges, that is, an upper edge and a lower edge of the stepwise difference of the nozzle 20, which is indicated by a dotted line "a" in FIG. 2B. Note that the ink liquid surface may be controlled by a known method used in a common inkjet recording head.

When ejecting ink droplets in this state (depending on the growth of an air bubble through heating of the heater 30), ink swells in the oblique direction downwardly of the nozzle 20 (the ink liquid surface) at an initial stage, as indicated by a dotted line "b" in FIG. 2B, and the ink droplets are ejected and fly in the direction corresponding to this expanding direction. Namely, in the illustrated case, the ink droplets are ejected towards the outside of the recording head 10 in the direction orthogonal to the nozzle rows, as indicated by the arrow direction x in FIG. 2A.

Figure 3:
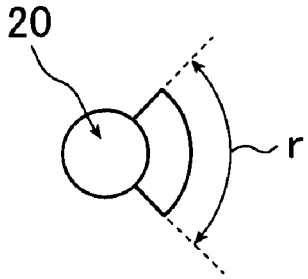
FIG. 3 is an explanatory schematic plan view of the inkjet recording head of the present invention.

The oblique ejection angle θ formed between this oblique ejection direction and the direction orthogonal to the substrate surface of the Si substrate 12 or the direction parallel to the central axis of the nozzle 20 in FIG. 2B can be adjusted by a stepwise difference h provided in the nozzle 20 in the depthwise direction on the surface side of the orifice plate 22 (on the side on which ink droplets are ejected). In other words, a height difference h in the nozzle 20, and an area r, having an angle of 180° in FIG. 2A and 90° in FIG. 3, where the stepwise difference (height difference) as shown in FIG. 2A or FIG. 3 is to be formed, (i.e., the flared portion). Usually, the ejection angle θ increases together with the increase of the stepwise difference h in the depthwise direction of the nozzle 20 (hereinafter also referred to simply as "height difference") or the increase of the area (or the flared portion) r. The height difference h is preferably within a range of 1 μm to 15 μm, especially 3 μm to 10 μm and, the area r is preferably within a range of 30° to 270°, particularly 90° to 180°.

Further, as a matter of course , the ejecting direction can be selected depending on the position where the stepwise portion is to be formed (direction in which the nozzle has a height difference).

Namely, the present invention eliminates the necessity of the configuration that may bring about declines of productivity and controllability such as providing obliquely bored holes for the nozzles or a plurality of heaters for one nozzle. The present invention, with the simple and preferable-productivity-yielded configuration giving the nozzle the height difference h in the depthwise direction, actualizes the oblique ejection of ink and is therefore capable of preventing, for instance, around-the-nozzle contamination of the ink splashed back from the image receiving paper and nozzle clogging.

Figure 4A:
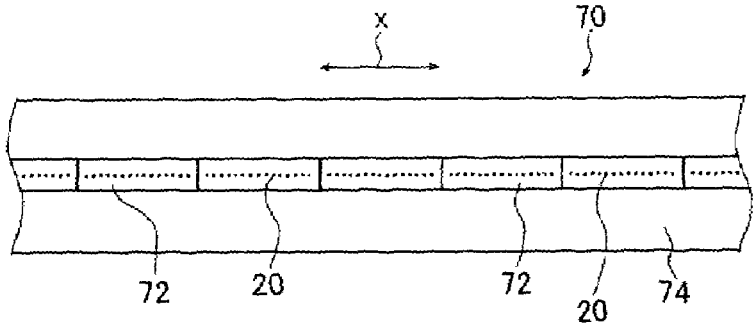
FIG. 4A is a schematic plan view showing one example of utilizing the inkjet recording head of the present invention.
Figure 4B:
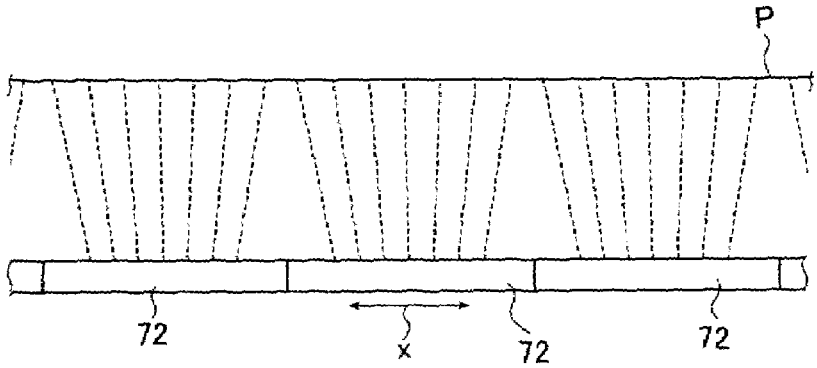
FIG. 4B is an explanatory schematic view showing an operation thereof.

Further, as described above, the ejecting direction of ink from each nozzle and the ejection angle θ can be selected and set by choosing the height difference h and the area r for each nozzle and further the position where the height difference h is to be provided. Therefore, for example, even in the case of forming a line head 70 by fixing short recording heads 72 to a substrate 74 so that they are joined together in the nozzle row direction as shown in FIGS. 4A and 4B, intervals (recording pitches) between ink droplets impinging on the image receiving paper P can be made uniform over the whole area. FIG. 4A is a plan view, and FIG. 4B is a side view as viewed from the image receiving medium conveying direction.

Further, the conventional scheme of the ink oblique ejection is basically unable to change the ejection angle θ and the ejecting direction of ink droplets after completing the recording head.

By contrast, according to the present invention, even after completing the recording head 10, the area r and the height difference h can be easily changed by machining the orifice plate 22. It is therefore possible to change the ejection angle θ and the ejecting direction of ink droplets after the recording head 10 has been completed. For instance, it is feasible to correct a manufacturing error, make an adjustment corresponding to an application of the recording head and make specialization suited to the user, etc.

According to the present invention, the method of giving the height difference in the depthwise direction of the nozzle by digging in the orifice plate, is not limited to the method of providing the stepwise difference as in the illustrated case. For example, it is possible to utilize a method in which the height difference continuously changing in the depthwise direction of the nozzle is provided as shown in FIG. 5, by digging in the orifice plate in the periphery of the nozzle so as to form an inclined surface.

Figure 5:
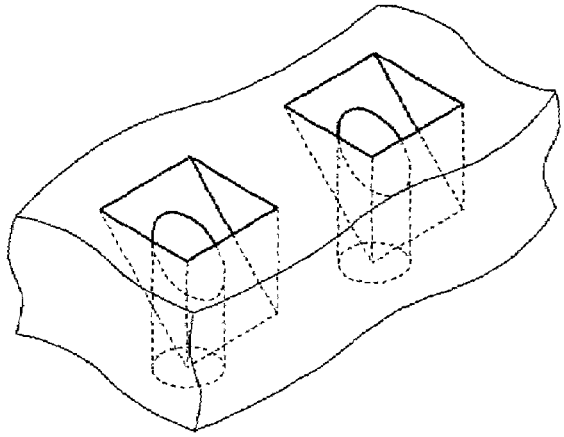
FIG. 5 is a schematic perspective view of an example of an orifice plate in the inkjet recording head of the present invention.
Figure 6A:
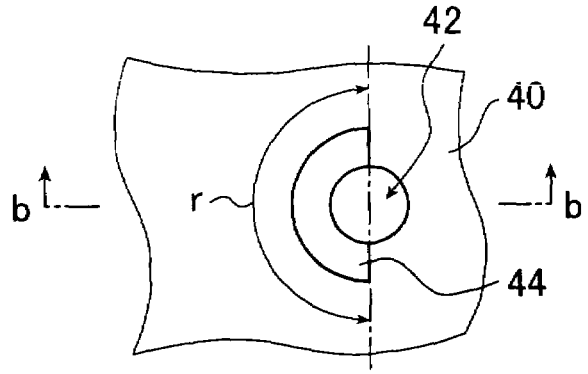
FIG. 6A is a schematic plan view of another example of the orifice plate in the inkjet recording head of the present invention.

Further, in the embodiments shown in FIGS. 2A, 2B and 5, the height difference in the depthwise direction of the nozzle is given by digging in the surface of the orifice plate 22, however, the present invention is not limited to this method. For instance, as shown in FIGS. 6A and 6B, the stepwise difference may be provided in the depthwise direction of a nozzle 42 by forming a semi-cylindrical protruded portion 44, which is defined by a 180-degree area r in the illustrated case, on the surface of the orifice plate 40.

Figure 6B:
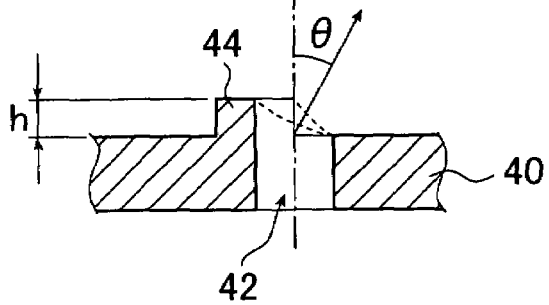
FIG. 6B is a sectional view taken along the line b—b in FIG. 6A.

In this configuration also, when the nozzle 42 is refilled with ink as indicated by a dotted line in FIG. 6B, the ink liquid surface is obliquely formed so as to connect the upper edge to the lower edge of the stepwise difference of the nozzle 42. Then, the ink swells in the oblique direction downwardly of the nozzle 42 (i.e., the ink liquid surface at the initial stage of ejecting ink droplets) and the ink droplets are ejected and fly in the direction corresponding to this expanding direction at the ejection angle θ.

Note that the height difference h and the area r in this embodiment may also be pursuant to the preceding embodiments.

It is preferable in the recording head according to the first aspect of the present invention that the area where the ink exists in the refilled state undergoes ink-philic processing, or hydrophilic processing in the case of usual aqueous ink; and that the areas other than the ink-existing area undergo ink-repellent processing, or water-repellent processing in the case of usual aqueous ink. To be more specific, in the embodiments shown in FIGS. 2A, 2B and 5, it is preferable that the ink-philic processing be effected on the inner wall surface of the nozzle, and the ink-repellent processing be effected on the stepwise difference portion formed by digging in the periphery of the nozzle. It is also preferable that the ink-philic processing is performed over the entire surface of the inner wall of the nozzle containing the protruded portion in the embodiment shown in FIGS. 6A and 6B.

The processing described above enables the ink liquid surface (the meniscus surface) to be formed in the predetermined position more advantageously and the ink droplet ejecting direction to be stabilized.

The embodiments given above refer to the oblique ejection of ink by providing the height difference in the depthwise direction of the nozzle. However, a second aspect of the present invention refers to the oblique ejection of ink by performing the ink-philic processing and the ink-repellent processing in asymmetry with respect to the central axis of the nozzle on the surface of the inner wall in the upper portion of the nozzle. In other words, by the combination of the ink-philic processing and the ink-repellent processing performed on the surface of the inner wall of the nozzle.

Figure 7A:
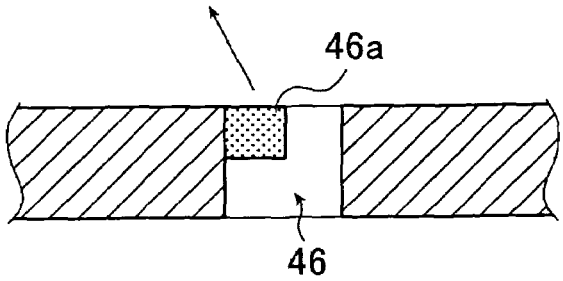
FIGS. 7A and 7B are schematic sectional views showing other examples of the orifice plates in the inkjet recording head of the present invention.

For example, as shown in FIG. 7A, a half of the peripheral area of the inner wall surface of the upper portion of a nozzle 46 as indicated by the shaded area 46*a*, is subjected to the ink-repellent processing, and the other areas are subjected to the ink-philic processing. Alternatively, as shown in FIG. 7B, the ink-repellent processing may be effected over an area 48*a* indicated by shading from a middle portion, positioned in the peripheral position, of the inner wall surface of the upper portion of a nozzle 48 towards an upper edge provided in the opposite position, and the areas other than the area 48*a* may be subjected to the ink-philic processing.

Note that the ink-repellent processing and the ink-philic processing may be performed by any known method in this aspect.

Figure 7B:
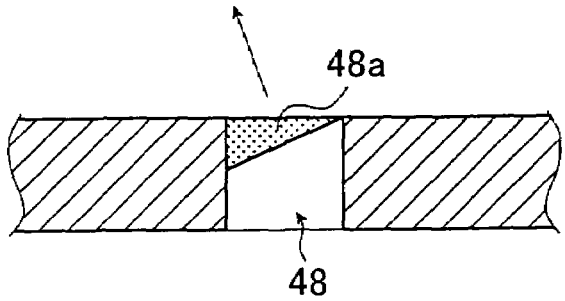

With this configuration, as in the preceding case, the ink liquid surface (meniscus surface) can be obliquely formed at the interface between the ink-repellent processing area and the ink-philic processing area, and by the same action, the liquid surface expands toward the lower level of the ink liquid surface at an initial stage of ejection, whereby the ink can be obliquely ejected in the direction as indicated by arrows in FIGS. 7A and 7B.

Further, the ejection angle θ and the ejecting direction of ink can be, as in the preceding case, selected by properly choosing the breadths and the positions of the ink-repellent processing area in the depthwise direction of the nozzle and of the ink-repellent processing area in the peripheral direction of the nozzle.

In the thus constructed recording head of the present invention, the area in which ink comes into contact with the inner wall of the nozzle, especially the portion corresponding to the upper edge of the ink liquid surface, is of much importance in terms of determining the ink ejecting direction. Hence, if this portion is damaged when wiping (rinsing of the surface of the orifice plate) and so on, or if there occurs declines of the ink-repellent and ink-philic performances, etc., this leads to a decrease in stability of the ink ejecting direction.

Figure 8A:
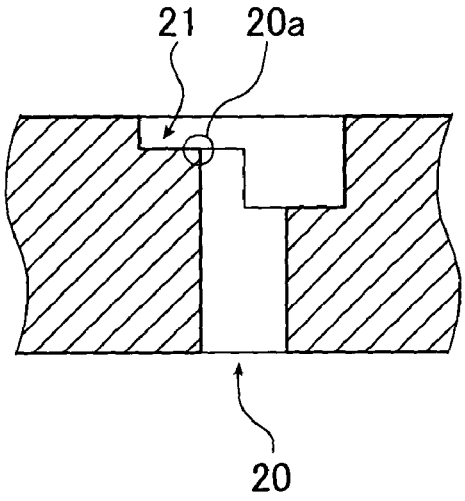
FIGS. 8A and 8B are schematic sectional views showing still other examples of the orifice plates in the inkjet recording head of the present invention.
Figure 8B:
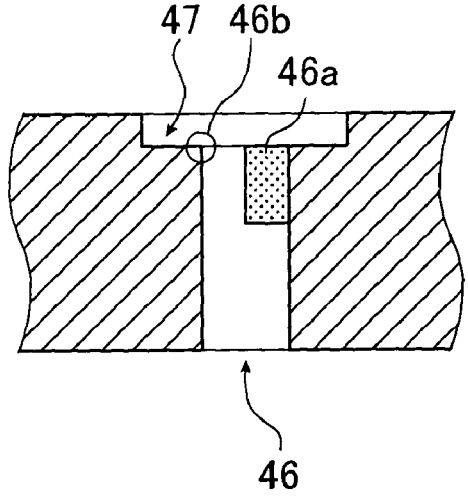

It is preferable to have a recess 21 or 47 in the surface of the orifice plate 22 and form a nozzle 20 or 46 therein as shown in FIG. 8A illustrating the nozzle 20 of FIGS. 2A and 2B, or FIG. 8B illustrating the nozzle 46 of FIG. 7A, thereby preventing the defects described above. By this process, a wiping member is prevented from coming into contact with the nozzle 20 or 46 during wiping and in particular a portion flush with the upper edge of the ink liquid surface (circled corner 20*a* or 46*b* in FIG. 8A or 8B), and the damage and the decline of the ink-repellent performance can be prevented.

Moreover, taking these points into consideration, other embodiments are more advantageous than the embodiment shown in FIGS. 6A and 6B that includes the protruded portion 44 provided on the surface of the orifice plate.

Figure 9:
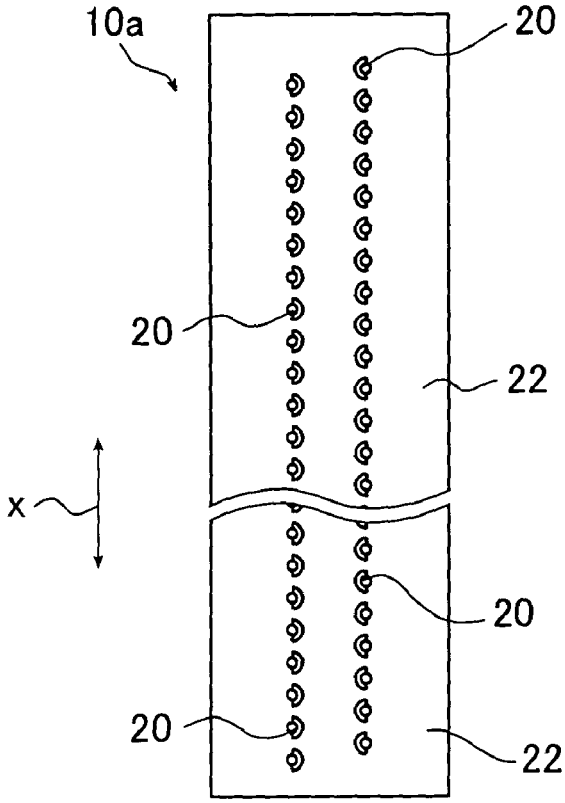
FIG. 9 is a schematic plan view showing another embodiment of the inkjet recording head of the present invention.

In the recording head 10 according to the first aspect of the present invention as shown in FIGS. 1A and 1B, the ejection angles at which ink droplets in two rows or in the direction x are ejected are slanted outside with respect to the recording head so that the direction in which ink droplets from the nozzles 20 in one of the two rows are ejected and the direction in which ink droplets from the nozzles 20 in the other row are ejected do not overlap each other and are thus oriented outside so as to prevent ink splashed back from the image receiving paper from making dirty the periphery of the nozzles or causing clogging in the nozzles. However, the present invention is not limited to this. In the recording head 10*a* shown in FIG. 9, both the directions in which ink droplets are ejected from the nozzles 20 in the two rows are oriented inside and the ejection angles of the ink droplets from the nozzles 20 in the two rows are appropriately slanted inside so that the ink droplets in the two rows can be close to each other or form a straight line on the image receiving paper, whereby the recording density of the recording head 10*a* can be improved, for example doubled. It is of course possible to further increase the recording density by allowing ink droplets in at least three rows among at least three nozzle rows to be close to each other or form a straight line on the image receiving paper.

The recording density of the recording head 10 according to the second aspect of the invention as shown in FIGS. 2A and 2B can be also improved in the same manner.

The recording heads according to the first and second aspects of the present invention may be manufactured by any known method.

For instance, the heaters 30, the drive circuits 14, the ink groove 16, the ink supply holes 18, the partition wall 15, etc., are formed for a multiplicity of recording heads 10 on the Si wafer (the Si substrate 12) by utilizing the semiconductor device manufacturing technology. Subsequently, the orifice plate 22 having no nozzles 20 formed therein is laminated and bonded, and the nozzles 20 are formed for the respective recording heads 10 by photolithography, thus completing a multiplicity of Si chips serving as the recording heads 10

Thereafter, the photolithography or the like is utilized to dig in the surface of the orifice plate 22, or the stepwise difference or the like is provided by forming the protruded portion on the surface. Alternatively, the inner wall of the nozzle 20 is subjected to the ink-philic processing and the ink-repellent processing in an asymmetric manner by, for example, a method of effecting patterning with a mask member embedded into the nozzle 20, a method of obliquely irradiating the nozzle 20 with directional ion beams and so on, which involves the use of the known processing methods disclosed in JP 2000-351210 A, etc.

Finally, the respective chips are cut out by dicing the Si wafer, then mounted in predetermined positions on the frame 24 for every individual recording head 10 and wired.

Figure 10A:
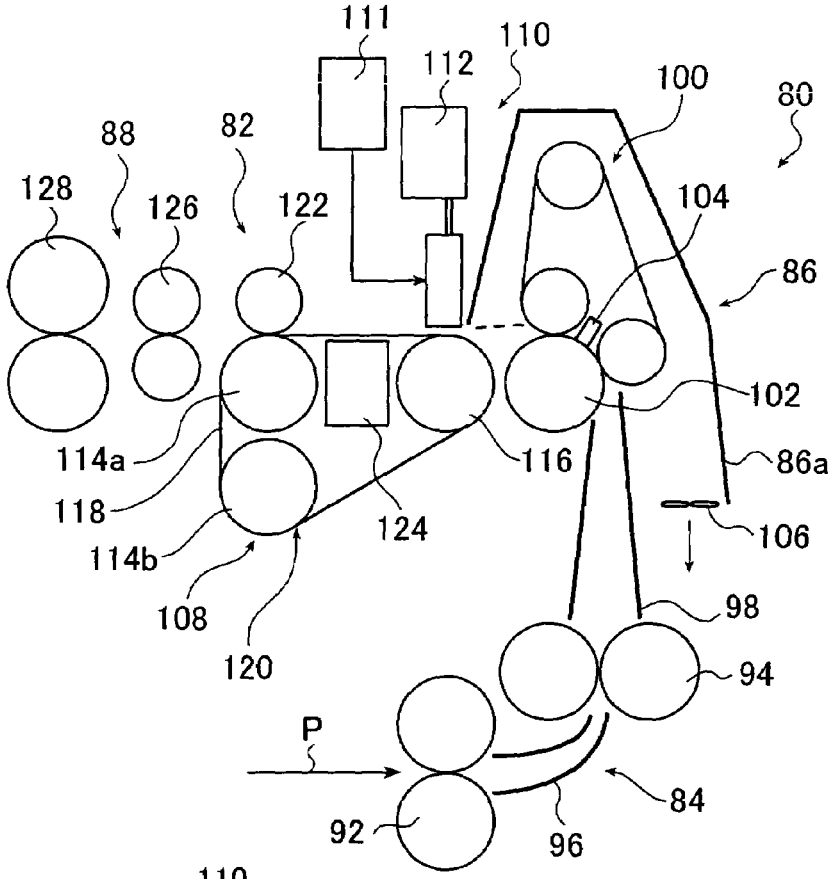
FIG. 10A is a schematic front view of an inkjet printer of the present invention.
Figure 10B:
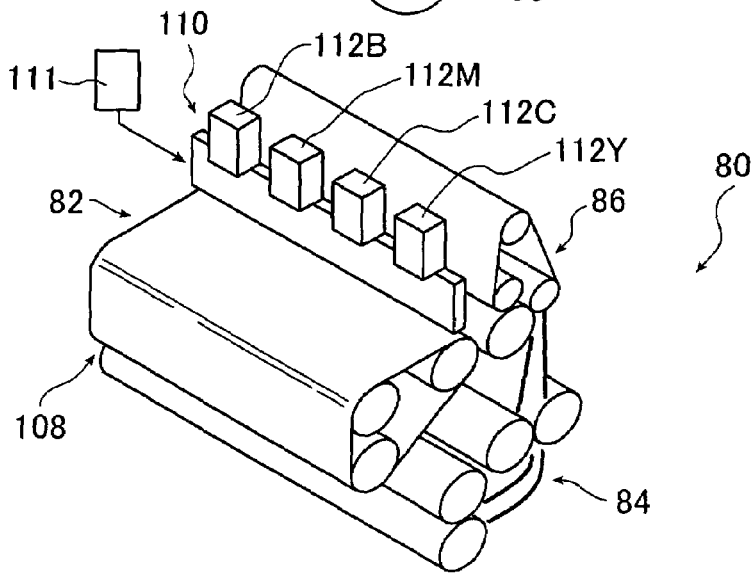
FIG. 10B is a perspective view of the inkjet printer shown in FIG. 10A.

FIGS. 10A and 10B show a schematic diagram and a schematic view of one embodiment of an inkjet printer of the present invention which uses the recording head of the present invention. FIG. 10A is a conceptual diagram showing a configuration of this inkjet printer. FIG. 10B is a conceptual view of this inkjet printer as viewed from an oblique direction.

An inkjet printer 80 (that will hereinafter simply called the printer 80) shown in FIGS. 10A and 10B is basically a known inkjet printer except that a recording head 110 of the present invention is used. A so-called line head including a nozzle row extending in excess of one side of the image receiving paper P, is used as the recording head 110.

The printer 80 illustrated in FIGS. 10A and 10B comprises a recording unit 82 using the recording head 110 of the present invention, a paper feeding unit 84, a preheating unit 86 and a discharging unit 88 (which is omitted in FIG. 10B). Note that the printer 80 may include, in addition to those components, a maintenance unit having a wiper, a cap, etc., for cleaning and protecting the recording head 10.

The paper feeding unit 84 includes two pairs of conveyance rollers 92, 94 and guides 96, 98. The image receiving paper P is conveyed upward from the horizontal direction by the paper feeding unit 84, and supplied to the preheating unit 86.

The preheating unit 86 has a conveyor 100 including three rollers and an endless belt, a press-fitting roller 102 pressed against the endless belt from outside of the conveyor 100, a heater 104 pressed against the press-fitting roller 102 (the endless belt) from inside of the conveyor 100, and an exhaust fan 106 for exhausting an interior or the preheating unit 86 (an interior of a housing 86*a*).

The thus constructed preheating unit 86 heats the image receiving paper P in advance of inkjet image recording, thereby speeding up drying of the ink. The image receiving paper P fed from the paper feeding unit 84 is heated by the heater 104 while being sandwiched between the conveyor 100 and the press-fitting roller 102 and thus conveyed, and further conveyed to the recording unit 82

The recording unit 82 includes the recording head 110 of the present invention and a conveying mechanism 108.

The recording head 110 is the recording head of the present invention which is a line head configured by joining the short heads at edge portions thereof as illustrated in FIGS. 4A and 4B. Each of the nozzles of the short heads therefore ejects, as described above, the ink obliquely to the nozzle row direction, thereby making uniform the pitches between the positions at which the ink impinges upon the image receiving paper P.

Further, the recording head 110 records a full-color image by ejecting ink in four colors of Y (yellow), C (cyan), M (magenta) and K (black), and is fitted with ink tanks 112 (112Y, 112C, 112M and 112B). It should be noted here that a controller 111 for controlling the ejection of ink droplets in each color from each of the nozzles 20 of the recording head 110 in accordance with image information (digital image data) is connected to the recording head 110.

Herein, this recording head 110 may takes such a structure that one short head contains four nozzle rows corresponding to the respective colors of ink, or four arrays of short heads as shown in FIG. 4A may be incorporated into the substrate, or four sets of line heads 70 as shown in FIG. 4A may also be incorporated therein. Note that the nozzle rows for the respective colors are, as a matter of course, arranged parallel with one another.

The conveying mechanism 108 has a conveyor 120 including rollers 114*a*, 114*b*, a suction roller 116 and a porous endless belt 118, a nip roller 122 (not shown in FIG. 10B) pressed against the porous endless belt 118, and a suction box 124 disposed within the conveyor 120.

The recording head 110 in disposed with its nozzle directed to the suction roller 116, wherein the nozzle row is set in the direction indicated by arrow x in FIG. 1A (in the direction perpendicular to the sheet surface in FIG. 10A).

Further, the conveying mechanism 108 conveys the image receiving paper P consecutively at a predetermined speed in the direction orthogonal to the nozzle row direction of the recording head 10. Accordingly, the entire surface of the image receiving paper P supplied from the preheating unit 80 is scanned by the nozzle row of the recording head 10 classified as the line head, thus recording the image.

Moreover, the suction roller 116 and the suction box 124 are operated during recording, whereby the image receiving paper P is conveyed while being in contact with the porous endless belt 118. The image receiving paper P is thus conveyed while being held in a predetermined position with respect to the recording head 10.

The image receiving paper P on which an image has been recorded is fed to the discharge unit 88, then conveyed by a conveyance roller pair 126 and a discharge roller pair 128 and discharged to, e.g., an unillustrated discharge tray.

Note that the inkjet printer of the present invention is not limited to the embodiments given above but a variety of known inkjet printers are available. For example, the printer may also be a serial type printer in which the image receiving paper described above is intermittently conveyed and the recording head (the head unit) scans by use of a carriage. Alternatively, the printer may also have a feeder for automatically feeding the image receiving paper.

In the recording heads according to the first and second aspects of the present invention as described above, the angle θ at which ink droplets are ejected is previously controlled and set based on the magnitude of the stepwise difference in the depthwise direction of the nozzles the size of the area where the stepwise difference is to be provided, and the combination of the ink-philic processing and ink-repellent processing. However, this is not the sole case of the present invention. The ejection angle θ of ink droplets may be previously controlled and set based on the shape and performance (capability) of ejection means and the position at which the ejection means in formed or placed, to be more specific, based on the size and performance of a heater or piezoelectric device, and the position where the heater is formed or the piezoelectric device is placed. Further, the ejection angle θ of ink droplets may be first controlled and set by adjusting the power to be applied to the ejection means in the recording head, for example the heater or the piezoelectric device. In the recording head 110 of the inkjet printer 80 as shown in FIGS. 10A and 10B for instance, the controller 111 may be used as the means for adjusting the power of the ejection means which adjusts the ejection angle θ at which ink droplets are ejected from the nozzles 20.

The inkjet recording head and the inkjet printer according to the present invention have been described in detail so far, however, the present invention is not limited to the embodiments discussed above and can be, as a matter of course, modified and changed in many ways within the scope of the present invention without departing from the gist of the present invention.

As discussed above in depth, according to the present invention, in a recording head elongated by joining a plurality of small-sized recording heads without forming the obliquely-bored holes for nozzles or a plurality of heaters, it is feasible to actualize a inkjet recording head capable of ejecting ink obliquely to the ejection surface for correcting recording pitches at joining portions and preventing the periphery of the nozzles from being contaminated by the ink splashed back from image receiving paper, and besides capable of preferably selecting and adjusting the ejection angle and the ejecting direction as well and exhibiting the preferable workability and productivity, and also actualize an inkjet printer using this inkjet recording head.

What is claimed is:

1. An inkjet recording head comprising:

a plurality of nozzles arrayed in one direction; and ink droplet ejecting means formed with respect to each of said plurality of nozzles, wherein at least one of said plurality of nozzles has a height difference in a depthwise direction on a side on which ink droplets are ejected and an ink liquid surface is formed between both edges forming the height difference and one of said ink droplet ejecting means corresponding to one nozzle in said at least one of said plurality of nozzles ejects said ink droplet in a direction inclined from a central axis direction of said one nozzle in accordance with said ink liquid surface formed at said one nozzle.

2. The inkjet recording head according to claim 1, wherein said height difference in the depthwise direction of each of said plurality of nozzles changes stepwise from a starting edge toward an ending edge of the height difference.

3. The inkjet recording head according to claim 1, wherein said height difference in the depthwise direction of each of said plurality of nozzles changes continuously from a starting edge toward an ending edge of the height difference.

4. The inkjet recording head according to claim 1, wherein said height difference in the depthwise direction of each of said plurality of nozzles is provided by forming a flared portion in at least part of a periphery of each of said plurality of nozzles on a surface side on which said ink droplets are ejected.

5. The inkjet recording head according to claim 1, wherein an inclination of an ink droplet-ejecting direction from a central axis direction of each of said plurality of nozzles is adjusted by at least one of a magnitude of said height difference in the depthwise direction of each of said plurality of nozzles, and a size of an area where said height difference in the depthwise direction is to be provided.

6. The inkjet recording head according to claim 1, further comprising power adjusting means for adjusting power of said ejecting means which is used to adjust an inclination of an ink droplet-ejecting direction from a central axis direction of each of said plurality of nozzles as determined by at least one of a magnitude of said height difference in the depthwise direction of each of said plurality of nozzles, and a size of an area where said height difference in the depthwise direction is to be provided.

7. The inkjet recording head according to claim 1, wherein an inner wall surface of at least one of said plurality of nozzles is subjected, on a side on which said ink droplets are ejected, to ink-philic processing and ink-repellent processing in asymmetry with respect to each central axis of said at least one of said plurality of nozzles.

8. The inkjet recording head according to claim 7, wherein an inclination of an ink droplet-ejecting direction from a central axis direction of each of said plurality of nozzles is adjusted by at least one of a magnitude of said height difference in the depthwise direction of each of said plurality of nozzles, a size of an area where said height difference in the depthwise direction is to be provided, and a combination of ink-philic processing and ink-repellent processing in an inner wall surface of each of said plurality of nozzles.

9. The inkjet recording head according to claim 7, further comprising power adjusting means for adjusting power of said ejecting means which is used to adjust an inclination of an ink droplet-ejecting direction from a central axis direction of each of said plurality of nozzles as determined by at least one of a magnitude of said height difference in the depthwise direction of each of said plurality of nozzles, a size of an area where said height difference in the depthwise direction is to be provided, and a combination of ink-philic processing and ink-repellent processing in an inner wall surface of each of said plurality of nozzles.

10. The inkjet recording head according to claim 1, wherein said plurality of nozzles are bored into an orifice plate, and said height difference of said nozzle is provided by digging in a surface of said orifice plate on a side, on which ink droplets are ejected, in said depthwise direction in the periphery of said nozzle or provided so as to protrude from said surface of said orifice plate in a direction opposite to said depthwise direction in the periphery of said nozzles.

11. An inkjet recording head comprising:

a plurality of nozzles arrayed in one direction; and ink droplet ejecting means formed with respect to each of said plurality of nozzles, wherein an inner wall surface of at least one of said plurality of nozzles is subjected, on a side on which said ink droplets are ejected, to ink-philic processing and ink-repellent processing in asymmetry with respect to each central axis of said at least one of said plurality of nozzles.

12. The inkjet recording head according to claim 11, wherein an inclination of an ink droplet-ejecting direction from a central axis direction of each of said plurality of nozzles is adjusted by a combination of ink-philic processing and ink-repellent processing in an inner wall surface of each of said plurality of nozzles.

13. The inkjet recording head according to claim 11, further comprising power adjusting means for adjusting power of said ejecting means which is used to adjust an inclination of an ink droplet-ejecting direction from a central axis direction of each of said plurality of nozzles as determined by a combination of ink-philic processing and ink-repellent processing in an inner wall surface of each of said plurality of nozzles.

14. An inkjet printer using an inkjet recording head comprising:

a plurality of nozzles arrayed in one direction; and ink droplet ejecting means formed with respect to each of said plurality of nozzles, wherein at least one of said plurality of nozzles has a height difference in a depthwise direction on a side on which ink droplets are ejected and an ink liquid surface is formed between both edges forming the height difference and one of said ink droplet ejecting means corresponding to one nozzle in said at least one of said plurality of nozzles ejects said ink droplet in a direction inclined from a central axis direction of said one nozzle in accordance with said ink liquid surface formed at said one nozzle.

15. The inkjet printer according to claim 14, wherein an inner wall surface of at least one of said plurality of nozzles is subjected, on a side on which said ink droplets are ejected, to ink-philic processing and ink-repellent processing in asymmetry with respect to each central axis of said at least one of said plurality of nozzles.

16. The inkjet printer according to claim 14, wherein said plurality of nozzles are bored into an orifice plate, and said height difference of said nozzle is provided by digging in a surface of said orifice plate on a side, on which ink droplets are ejected, in said depthwise direction in the periphery of said nozzle or provided so as to protrude from said surface of said orifice plate in a direction opposite to said depthwise direction in the periphery of said nozzles.

17. An inkjet printer using an inkjet recording head comprising:

a plurality of nozzles arrayed in one direction; and ink droplet ejecting means formed with respect to each of said plurality of nozzles, wherein an inner wall surface of at least one of said plurality of nozzles is subjected, on a side on which said ink droplets are ejected, to ink-philic processing and ink-repellent processing in asymmetry with respect to a central axis of said at least one of said plurality of nozzles.

* * * * *